US005963928A

United States Patent [19]

Lee

[11] Patent Number: 5,963,928

[45] Date of Patent: Oct. 5, 1999

[54] SECURE METERING VAULT HAVING LED OUTPUT FOR RECOVERY OF POSTAL FUNDS

[75] Inventor: David K. Lee, Monroe, Conn.

[73] Assignee: Pitney Bowes Inc., Stamford, Conn.

[21] Appl. No.: 08/895,872

[22] Filed: Jul. 17, 1997

[51] Int. Cl.[6] ..... G07B 17/00

[52] U.S. Cl. ..... 705/401; 705/410; 714/712

[58] Field of Search ..... 270/32, 58.01; 705/410, 401; 714/703, 712; 702/182, 183, 185

[56] References Cited

U.S. PATENT DOCUMENTS

| | | | |
|---|---|---|---|
| 4,459,582 | 7/1984 | Sheahan et al. | 340/539 |
| 4,686,912 | 8/1987 | Fogleman et al. | 109/59 T |
| 4,918,601 | 4/1990 | Vermesse et al. | 364/464.02 |
| 5,410,590 | 4/1995 | Blood et al. | 379/147 |
| 5,573,233 | 11/1996 | Hirai et al. | 270/85.08 |
| 5,579,234 | 11/1996 | Wiley et al. | 702/118 |

*Primary Examiner*—Edward R. Cosimano
*Attorney, Agent, or Firm*—Charles R. Malandra, Jr; Melvin J. Scolnick

[57] ABSTRACT

A secure metering vault for use with a host printing module via a secure communication link includes a secure output device such as a light emitting diode (LED) configured for outputting the available postal funds stored in the secure metering module in response to a detected malfunction in the secure communication link. The vault includes a processor that monitors the condition of the secure communication link, and that controls the storage and updating of the stored available postal funds in a nonvolatile memory. If a failure is detected in the communication link, the processor outputs to the LED the stored value of the available postal funds based upon a prescribed format, such as Morse code or some other blinking pattern that is equivalent to the postal funds remaining in the vault. Use of the secure output device to output the stored available postal funds enables a user to recover the funds without tampering with the secure metering module, which may otherwise cause self-destruction of the vault or deletion of the available postal funds from memory.

25 Claims, 2 Drawing Sheets

SECURE METERING VAULT HAVING LED OUTPUT FOR RECOVERY OF POSTAL FUNDS

BACKGROUND OF THE INVENTION

1. Technical Field

This invention relates to secure modular postage printing systems, where a secure metering module stores available postal funds for a host printing module.

2. Background Art

Postage metering systems have been developed in a modular arrangement, where a host printing module, also referred to as a mailing machine, includes a printer configured for printing indicia that indicate the value of the postage being applied. The control signals associated with printing the corresponding indicia are generated by a secure metering module, also referred to as a vault, which stores the available postal funds for the value printing system.

An important consideration in an electronic postal mailing system is that the postal funds within the secure metering module (i.e., the vault) are secure, where the host printing module prints postage indicia on a mail piece, and where the accounting registers within the secure metering module accurately reflect the available postal funds relative to the printing of the postage indicia by the printing module. Postal authorities generally require the accounting information to be stored within the postage meter and to be held in a secure manner, such that any postal mailing system should include security features to prevent unauthorized and unaccounted for changes in the amounts of postal funds held in the meter. Postal authorities also require that meters be put in service and removed from service in strict compliance with postal requirements for registration and periodic inspection, for example every six months. Hence, the security and inspection requirements by the postal authorities enables the postal authorities to keep reliable records on the usage of the meter, as well as to detect fraud.

The security requirement for the vault has generally required the actual metering module to have a secure physical housing that physically protects the stored postal funds and associated encryption keys, such that postal and accounting information can be accessed to and from the vault only by a secure communication link between the vault and the external host printing module. The vault may also include a tampering detection device designed to detect tampering of the physical or electronic integrity of the fault. If tampering is detected by an unauthorized agency, the vault may self-destruct by deleting the encryption keys, or by deleting the available postal funds from the memory.

The secure nature of the vault creates difficulties when attempting funds recovery, where a user attempts to read a value of the remaining funds stored in the vault from a malfunctioning vault. Typically, a user may attempt to disassemble the secure vault and determine the stored funds using electronic probes to read back electronic signals. However, a tampering detection device within the vault may consider the funds recovery attempt as a tampering attempt, causing the tampering detection system to destroy the electronic memory. Hence, if a vault malfunctions, the stored available postal funds in the vault may be lost, creating substantial expense and inconvenience for the user.

DISCLOSURE OF THE INVENTION

There is a need for an arrangement for recovering funds from a secure metering module in a modular postal mailing system while maintaining the integrity of the secure metering module.

There is also a need for an arrangement for recovering funds from a secure metering module of a modular postal mailing system that provides user feedback including funds recovered without any interaction or interfacing by the user.

These and other needs are attained by the present invention, where a secure metering module has a secure output device configured for outputting the stored available postal funds from the secure metering module in response to a detected malfunction in a secure communication link.

According to one aspect of the present invention, in a modular postal mailing system for the printing of indicia having a postal value, a secure metering module includes a nonvolatile memory configured for storing available postal funds, a communication port configured to establish a secure communication link between the secure metering module and an external host processor controlling printing of the indicia, a processor configured for updating the stored available postal funds based on the printing of the indicia at the corresponding postal value, the processor configured for detecting a malfunction in the secure communication link, and a secure output device configured for outputting the stored available postal funds from the secure metering module in response to the detected malfunction. Use of the secure output device enables a user to recover the available postal funds without the necessity of any interaction with the secure metering module. Hence, the user may recover funds from the secure metering module without supplying any inputs to the secure metering module or performing any actions on the secure metering module that may affect the integrity of the secure metering module.

Another aspect of the present invention relates to a method in a secure metering module for use in a modular postal mailing system having a host processor controlling printing of indicia having a postal value and a secure metering module storing available postal funds and having a communication port configured for establishing a secure communication link with the host processor. The method of the present invention includes determining an operating condition of the secure metering module, detecting a failure in the communication link, and selectively outputting via a secure output device in the secure metering module at least one of a status indication of the determined operation condition and a funds indication of the stored available postal funds based on the determined operating condition and the detection of the failure. The selective output of status indication and funds indication via the secure output device enables a user to determine the operating condition of the secure metering device during normal operation. Moreover, the selective output by the secure output device enables a user to recognize a malfunction in the secure metering device, while at the same time perform funds recovery without tampering with the device.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein.

DETAILED DESCRIPTION OF THE PREFERRED EMBODIMENT

Figure 1:
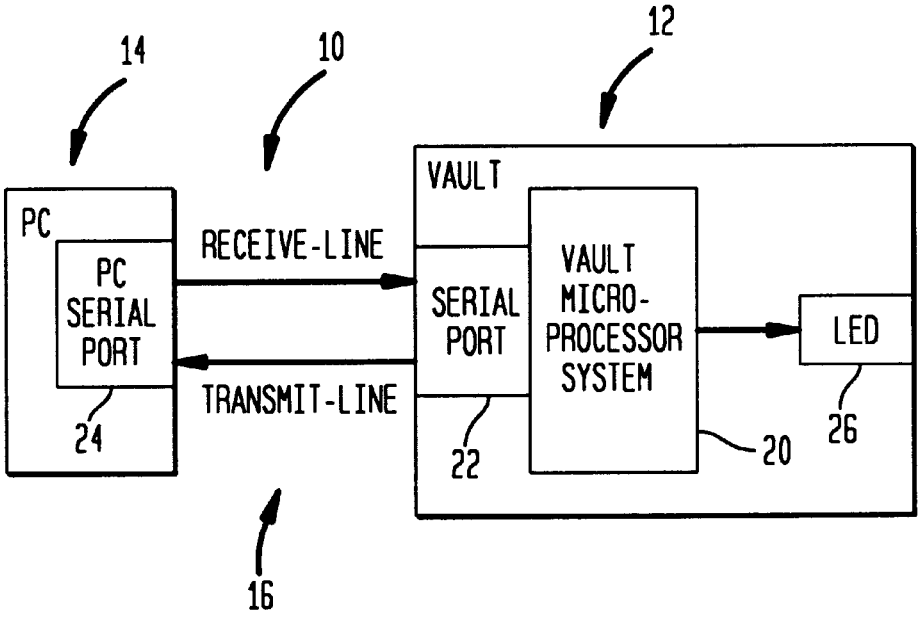
FIG. 1 is a block diagram of a modular postal mailing system having a secure metering module according to an embodiment of the present invention.

FIG. 1 is a block diagram illustrating a modular postal mailing system 10 having the secure metering module of the present invention. The modular postal mailing system 10 may be configured as a Class II meter according to U.S. postal regulations. The modular postal mailing system 10 includes a secure metering module 12 (i.e., a vault) that stores available postal funds, an external host processor 14 in communication with the vault 12 via a secure communication link 16 and that prints value indicia such as postage indicia based on the available postal funds stored in the vault 12. The host 14, for example a personal computer, is configured for postage printing and includes a serial port interface 24 for coupling the secure metering module 12 to the host 14 via a secure two-way data communication link 16 between the host 14 and the vault 12. The host 14 runs at least one software application for postage processing and controlling the printer associated with the host 14. The vault 12 comprises a vault microprocessor system that stores the available postal funds, and that controls overall operations of the vault 12. The vault microprocessor system 20 sends electronic signals through a serial port 22 to the host 14 via the secure communication link 16.

Figure 2:
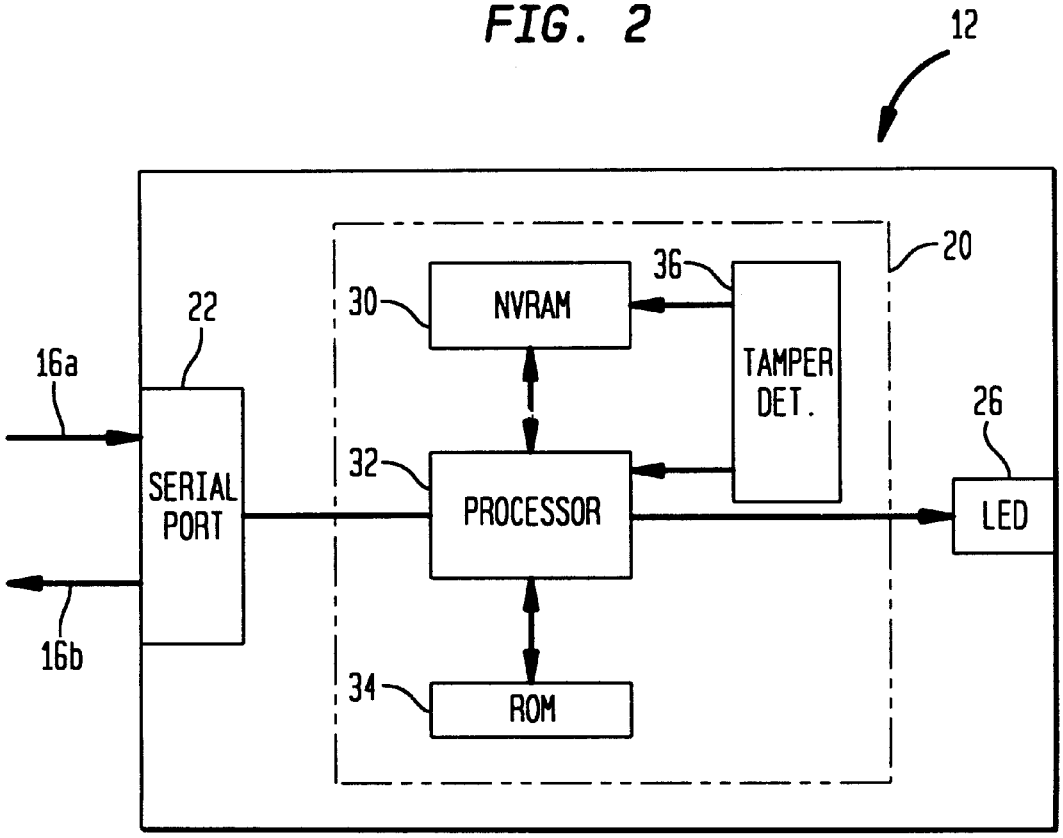
FIG. 2 is a block diagram illustrating the vault microprocessor system of FIG. 1.

FIG. 2 is a block diagram illustrating in further detail an exemplary implementation of the secure metering module 12. The vault microprocessor system 20 includes a nonvolatile RAM (NVRAM) 30 that stores available postal funds information, a processor 32, a read only memory (ROM) 34, and a tamper detection circuit 36. The processor 32 is configured for updating the stored available postal funds based on printing status messages received from the host 14 via the receive line 16*a*. The serial port 22, upon receiving the message, forwards the received encrypted message to the processor 32 for decryption and updating of the accounting information including the available postal funds stored in the NVRAM 30. As recognized in the art, encryption and decryption keys associated with maintaining the security of the communication link 16 may be stored either in the NVRAM 30 or the ROM 34.

The processor 32 and the memory (including the NVRAM 30 and the ROM 34) perform all postage accounting functions, such as maintaining ascending and descending register values. The processor system 20 also may perform a variety of encryption functions, including generation of digital signatures for inclusion in postage indicia and for inclusion in data messages exchanged with a postal service data center during recharging of the available postal funds in the vault 12. Verification of authenticity of the secure metering module 12 according to U.S. postal regulations may include an exchange of signals between the host 14 and the secure metering module 12, where at least some of the signals are encrypted.

In a postage printing operation, the user might use the keyboard of the host computer 14 to enter a desired postage amount. The host computer supplies the postage value to the secure metering module 12 via the secure communication link 16. The secure metering module generates a postage indicium in accord with the U.S. Postal Service specifications, and supplies the signals representing the indicium to the host 14, to drive the printer and print the addition on a mail piece.

The printed indicium includes certain human readable information such as the date and the postage amount. The indicium also includes a two-dimensional bar code. The bar code contains in-the-clear information such as PSD identification, postage value and various routing information. The bar code also includes a digital signature formed by encryption of certain data specified by the U.S.P.S. The data used at the input to the encryption process for the digital signature includes service ID information, the ascending and descending register values, a special purpose field, the postage value, licensing zip code, the date and the amount of postage.

As shown in FIG. 2, the vault microprocessor system 20 also includes a tamper detection unit 36 configured to detect a tampering attempt on the secure metering module 12. For example, the tamper detection unit 36 may include electrical or physical sensors configured to detect a breach of the physical housing of the secure metering module 12, or unauthorized electrical activity on either the serial port 22 or elsewhere within the secure metering module 12. Upon detecting a tampering attempt, the tamper detection unit 36 causes deletion of the available postal funds in the nonvolatile memory 30, for example by sending a tampering signal to the processor 32 which then deletes the available postal funds from the NVRAM 30. Alternatively, the tamper detection unit 36 may directly delete the available postal funds from the NVRAM 30 in response to the detected tampering attempt. Although the tamper detection unit 36 is disclosed as separate from the processor 32, the tamper detection unit 36 may also be incorporated as part of the functionality of the processor 32.

As described above, the security requirements of the secure metering module 12 creates difficulties when attempting funds recovery, where a user attempts to read a value of the remaining funds stored in the vault after a communication failure in the secure communication link 16. Hence, an alternative means for communicating the available postal funds stored in the secure metering module is necessary in the event a malfunction occurs in the secure communication link 16, regardless of whether the malfunction is in one of the serial ports 22 or 24, or within the receive line 16*a* or the transmit line 16*b*.

According to the disclosed embodiment, the secure metering module includes a secure output device 26 configured for outputting the stored available postal funds from the secure metering module 12 in response to a malfunction detected in the secure communication link 16. The term "secure output device" refers to an output-only device that cannot be compromised by tampering attempts. According to the disclosed embodiment, the secure output device is implemented as a light emitting diode (LED) 26 that outputs a wireless signal as an optical signal having a prescribed format, described below. Hence, the processor 32, upon detecting a malfunction in the secure communication link 16, generates error signals to the LED 26 representing the available postal funds in response to the detected malfunction. The LED 26 in response outputs visually-perceptible signals representing the stored available postal funds from the secure metering module 12 in response to the error signals from the processor 32. Although the disclosed arrangement describes the secure output device as an LED 26, an alternative secure output device may be implemented, for example a wireless transmitter such as an RF transmitter.

Use of the LED 26 can also be combined with normal operations to provide a user with visual feedback as to the normal operation of the vault 12, enabling a user to distinguish between normal operation and error conditions in the host processor 14 for troubleshooting purposes, as well as providing funds recovery due to failure on the secure communication link 16.

Figure 3:
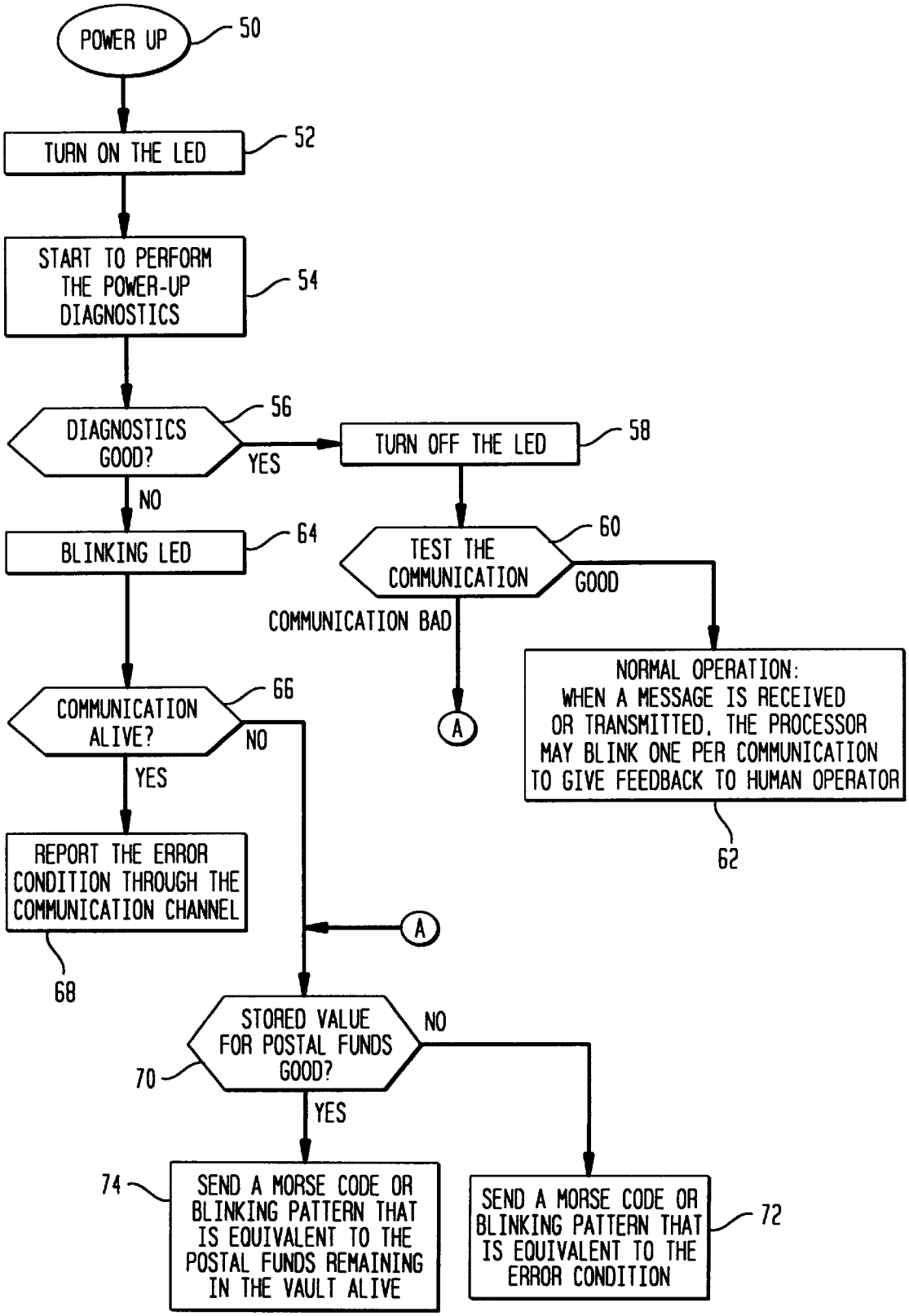
FIG. 3 is a flow diagram of a method in the secure metering module for selectively outputting status indicia and funds indicia for fault recovery according to an embodiment of the present invention.

FIG. 3 is a flow diagram illustrating a method of outputting status and error information relating to the secure output device 26 to enable a user to determine the operating condition of the secure metering module 12, as well as to perform funds recovery in the event of a failure in the communication link 16. The method begins in step 50, where the processor 32 is powered up and turns on the LED 26 in step 52 to indicate to a user that power is connected successfully to the secure metering module 12. The processor 32 will continue to maintain the LED in an active state while performing power up diagnostics stored in the ROM 34 in step 54. The LED 26 may output a prescribed pattern of status indicia based on driving signals from the processor 32 during the power up diagnostics. For example, the LED 26 may be driven at a reduced intensity, or alternatively the LED 26 may blink according to a prescribed pattern, for example, one pulse per second with a 50% ON/OFF duty cycle, during performance of the system check in step 54. The diagnostics may include integrity check of the components of the vault for physical integrity and functional operability. If the processor 32 determines in step 56 that the vault 12 passes all the diagnostics, the processor 32 turns off the LED in step 58, indicating that the system check was successful. Assuming diagnostics were satisfactory, the processor 32 then checks the communication link 16 in step 60. As recognized in the art, the processor 32 may check the communication link 16 by a prescribed protocol with the host processor 14 between the respective serial ports 22 and 24. If the processor determines in step 60 that the secure communication link 16 is operating normally, then the processor 32 enters a normal operation mode in step 62, where the processor may cause the LED 26 to blink a first and second pattern whenever a message is transmitted and received successfully by the secure metering module 12, respectively, to provide feedback of the communication to a human operator. If, however, the processor 32 determines that the secure communication link 16 is not operating normally, the processor 32 checks in step 70 if the stored values for the available postal funds are valid, using known error detection and encryption techniques. Depending upon the determination made by the processor 32 in step 70, the processor 32 proceeds in accordance with either step 72 or step 74 described in detail below.

As described above, the processor 32 checks in step 56 whether the power up diagnostics performed in step 54 are satisfactory. If in step 56 the processor 32 determines that a portion of the vault 12 fails the diagnostics, the processor 32 may cause the LED 26 to blink in step 64 according to a prescribed pattern corresponding to a diagnostic failure, for example two pulses per second for thirty seconds. The processor 32 then checks in step 66 whether there is any communication on the secure communication link 16, for example by sending one message and waiting for a response from the host processor 14, although other communication protocol may be used, especially depending on whether the secure metering module 12 is configured as a master device or a slave device.

If in step 66 the processor 32 determines that communications are possible with the host processor 14, the processor 32 outputs a message to the host processor in step 68 reporting the error condition through the communication channel 16. However, if no communication is possible across the secure communication link 16, the processor 32 checks in step 70 if the stored values for the available postal funds are valid, using known error detection and encryption techniques. If in step 70 the processor 32 determines that the stored values for the available postal funds are invalid, the processor 32 outputs in step 72 an operating condition error signal to the LED 26, for example a Morse code or blinking pattern indicating a general failure of the vault 12. However, if in step 70 the processor 32 determines that the stored value for the available postal funds is valid, the processor 32 outputs a funds indication of the stored available postal funds to the LED 26, for example as a Morse code sequence, or any other recognizable blinking pattern equivalent to the postal funds remaining in the vault 12.

Hence, the LED 26 can be used as a secure output device to provide status indication of the determined operating condition of the vault 12, as well as a secure arrangement for recovering the stored available postal funds upon detecting a failure in the communication link 16. In case the vault receive line 16*a* is operating and the transmit line 16*b* is inoperable, the processor 32 may trigger the LED response according to a prescribed error detection scheme, for example if the vault receives a status message five times in a row from the host processor 14, as opposed to receiving acknowledgement messages according to a prescribed communication protocol. In the case that the receive line 16*a* is broken, the processor 32 may determine that a communication failure has occurred if the vault 12 detects no communication from the power up for 10 seconds, where the failure to detect any communication is repeated over a prescribed number of power up conditions.

As described above, the detection of a failure on the secure communication link 16 depends on the communication protocol between the secure metering module 12 and the host processor 14. If the secure metering module 12 is configured as a slave device, where the secure metering module 12 is not permitted to transmit unless instructed from the host processor 14, the processor 32 determines a communication failure upon determining the lack of any communication activity at power up for a prescribed interval, for example no message received for ten seconds, where the inactivity condition is repeated for five consecutive power ups. Conversely, if the secure metering module initiates a communication, the secure metering module 12 can detect a communication immediately.

As described above, the secure metering module 12 can assume a communication hardware failure if failures are observed over a predetermined number of consecutive power ups. Since the processor 32 can also track the number of consecutive hardware failures by storing the failure conditions in the nonvolatile memory 30.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A secure metering module of a modular postal mailing system comprising:

a nonvolatile memory configured for storing available postal funds;

a communication port configured to establish a secure communication link between the secure metering module and an external host processor the external host processor controlling printing of indicia having a corresponding postal value;

a processor configured for updating the stored available postal funds based on the corresponding postal value of a printed indicia, the processor configured for detecting a malfunction in the secure communication link; and a secure output device configured for outputting the stored available postal funds from the secure metering module in response to the detected malfunction.

2. The module of claim 1, wherein the processor generates status information signals specifying a status of the secure metering module, the secure output device outputting status indicia in response to the status information signals.

3. The module of claim 2, wherein the status indicia include at least one of a successful power connection, a system check, a successful message transmission to the external host processor via the communication port, and a successful message reception from the external host processor via the communication port.

4. The module of claim 2, wherein the processor is configured to identify the detected malfunction on at least one of a transmit line and a receive line of the communication link.

5. The module of claim 1, wherein the processor detects the malfunction based on failure to receive a prescribed message from the external host processor over a prescribed interval.

6. The module of claim 5, wherein the prescribed interval corresponds to a prescribed number of time intervals following respective power-up conditions.

7. The module of claim 5, wherein the secure output device is configured to output status indicia in response to successful transmission/reception of a message to/from the host processor.

8. The module of claim 1, wherein the secure output device outputs the postal funds information as a wireless signal having a prescribed format.

9. The module of claim 8, wherein the secure output device is a light emitting diode (LED) outputting the wireless signal as an optical signal, the processor outputting LED driver signals specifying the stored available postal funds according to the prescribed format.

10. The module of claim 9, wherein the prescribed format is Morse code.

11. The module of claim 9, further comprising a tamper detection unit configured to detect a tampering attempt on the secure metering module, the tamper detection unit causing deletion of the available postal funds from the nonvolatile memory in response to the detected tampering attempt.

12. A secure metering module of a modular postal mailing system comprising:

a nonvolatile memory configured for storing available postal funds;

a communication port configured to establish a secure communication link between the secure metering module and an external host processor, the external host processor controlling printing of indicia having a corresponding postal value;

a processor configured for deleting the nonvolatile memory in response to a detected tampering attempt and for detecting a malfunction in the secure commnunication link, the processor generating error signals representing the available postal funds in response to the detected malfunction; and a secure output device for outputting visually-perceptible signals representing the stored available postal funds from the secure metering module in response to the error signals.

13. The module of claim 12, wherein the processor generates status information signals specifying a status of the secure metering module, the secure output device outputting status indicia in response to the status information signals.

14. The module of claim 13, wherein the status indicia include at least one of a successful power connection, a system check, a successful message transmission to the external host processor via the communication port, and a successful message reception from the external host processor via the communication port.

15. The module of claim 13, wherein the processor is configured to identify the detected malfunction on at least one of a transmit line and a receive line of the communication link, the processor simultaneously outputting a funds availability message specifying the stored available postal funds on the transmit line and an output signal specifying the stored available postal funds to the secure output device in response to the identification of the detected malfunction in the receive line.

16. The module of claim 12, wherein the processor detects the malfunction based on failure to receive a prescribed message from the external host processor over a prescribed interval.

17. The module of claim 16, wherein the prescribed interval corresponds to a prescribed number of time intervals following respective power-up conditions.

18. The module of claim 16, wherein the secure output device is configured to output status indicia in response to successful transmission/reception of a message to/from the host processor.

19. The module of claim 12, wherein the secure output device outputs the postal funds information as a wireless signal having a prescribed format.

20. The module of claim 19, wherein the secure output device is a light emitting diode (LED) outputting the wireless signal as an optical signal, the processor outputting LED driver signals specifying the stored available postal funds according to the prescribed format.

21. The module of claim 20, wherein the prescribed format is Morse code.

22. The module of claim 20, further comprising a tamper detection unit configured to detect a tampering attempt on the secure metering module, the tamper detection unit causing deletion of the available postal funds from the nonvolatile memory in response to the detected tampering attempt.

23. In a secure metering module of a modular postal mailing system, the secure metering module storing available postal funds and having a communication port configured for establishing a secure communication link with an external host processor, a method in the secure metering module comprising:

determining an operating condition of the secure metering module;

detecting a failure in the communication link; and selectively outputting via a secure output device in the secure metering module at least one of a status indication of the determined operating condition and a funds indication of the stored available postal funds based on the determined operating condition and the detection of the failure.

24. The method of claim 23, wherein the selectively outputting step comprises outputting as a wireless signal in a prescribed format the stored available postal funds in response to the detected failure in the communication link.

25. The method of claim 24, wherein:

the secure metering module includes a processor and the secure output device is a light emitting diode (LED);

the detecting step comprising detecting by the processor a failure to receive a prescribed message from the host processor within a prescribed interval; and the selectively outputting step comprises outputting from the processor a driver signal corresponding to the stored available postal funds, and generating by the LED the wireless signal in response to the driver signal.

* * * * *